US006634126B2

(12) United States Patent
Ruffino

(10) Patent No.: US 6,634,126 B2
(45) Date of Patent: Oct. 21, 2003

(54) LOTTERY CARD READER

(76) Inventor: Peter J. Ruffino, 273 Wellington Rd., Buffalo, NY (US) 14216

( * ) Notice: Subject to any disclaimer, the term of this patent is extended or adjusted under 35 U.S.C. 154(b) by 109 days.

(21) Appl. No.: 09/745,524

(22) Filed: Dec. 23, 2000

(65) Prior Publication Data

US 2002/0078611 A1 Jun. 27, 2002

(51) Int. Cl.[7] ..... G09F 3/20; G09F 3/18

(52) U.S. Cl. ..... 40/658; 40/661; 24/10 R; 24/546

(58) Field of Search ..... 40/658, 661, 666; D19/88; 434/408, 415; 248/229.16; 24/10 R, 11 CC, 11 R, 335, 336, 546, 547

(56) References Cited

U.S. PATENT DOCUMENTS 4,010,517 A * 3/1977 Kapstad ..... 24/67.11
4,292,749 A * 10/1981 Thomas ..... 40/308
4,746,045 A * 5/1988 Schweim ..... 224/274
4,909,383 A * 3/1990 Gross ..... 206/39
5,133,554 A * 7/1992 Piccinini, Sr. ..... 273/148 R
5,145,141 A * 9/1992 Hunter ..... 248/452
5,400,990 A * 3/1995 Frankel ..... 248/215
5,647,156 A * 7/1997 Hull et al. ..... 40/661
5,820,095 A * 10/1998 Stone ..... 248/316.7
5,887,902 A * 3/1999 Irwin et al. ..... 281/45

* cited by examiner

*Primary Examiner*—Brian K. Green
(74) *Attorney, Agent, or Firm*—Richard D. Fuerle

(57) ABSTRACT

A lottery card reader is disclosed. The lottery card reader comprises (A) a clip that can be releaseably attached to any position along an edge of a lottery card and (B) a transparent flap attached to the clip that extends over at least one game on a lottery card when the clip is attached to a lottery card. Also disclosed is a method of checking a lottery card for winning numbers using the lottery card reader. Further disclosed is an assembly of the lottery card reader and a lottery card, a writing instrument, and/or an envelope into which lottery cards can be placed.

14 Claims, 3 Drawing Sheets

LOTTERY CARD READER

BACKGROUND OF THE INVENTION

This invention relates to a lottery card reader that can be used to easily check a lottery card to determine if the numbers chosen were winning numbers. In particular, it relates to a lottery card reader that can be moved along a lottery card and can grip it at any position, and that has a transparent flap on which the winning numbers can be marked.

Numerous states in the United States operate lotteries as a way of raising money. Many of these lotteries use a card printed with groups of numbers, each group constituting a separate game of chance. A person may purchase any or all of the games on a card. He plays the games by marking his choice of numbers in each game he bought. A machine then reads the card and returns it to the player.

When the winning numbers are announced, the purchaser must compare the winning numbers to the numbers he chose on his card. If he purchased only one game, the comparison is easily accomplished. But if several games were played, the comparison must be made for each game, and that can be tedious, time-consuming, and prone to error.

Various types of lottery card readers have been invented to help a person determine his winning numbers. Some of these readers must be punched out in the proper position for each winning number, which may lead to errors if the hole is not made in precisely the correct position. Others are suitable for reading the cards of only one type of game, or the cards from only one state, and cannot be used for cards of other states or other types of games.

SUMMARY OF THE INVENTION

I have invented a lottery card reader that is simple, inexpensive, and can be used to accurately read almost any lottery card. Using the lottery card reader of this invention requires only marking the winning numbers on the reader and sliding it across the lottery card to the position of each game.

DESCRIPTION OF THE PREFERRED EMBODIMENTS

Figure 1:
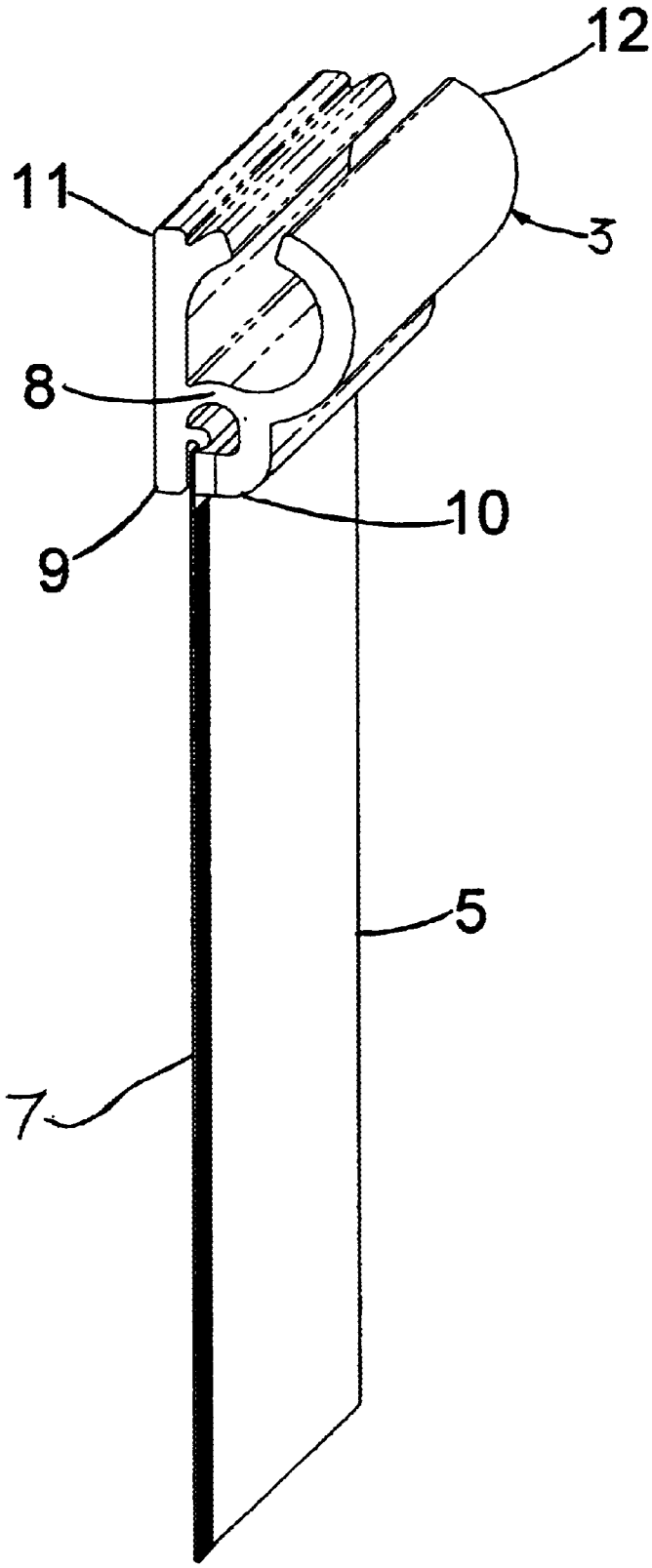
FIG. 1 is an isometric view of a certain presently preferred embodiment of a lottery card reader according to this invention.
Figure 2:
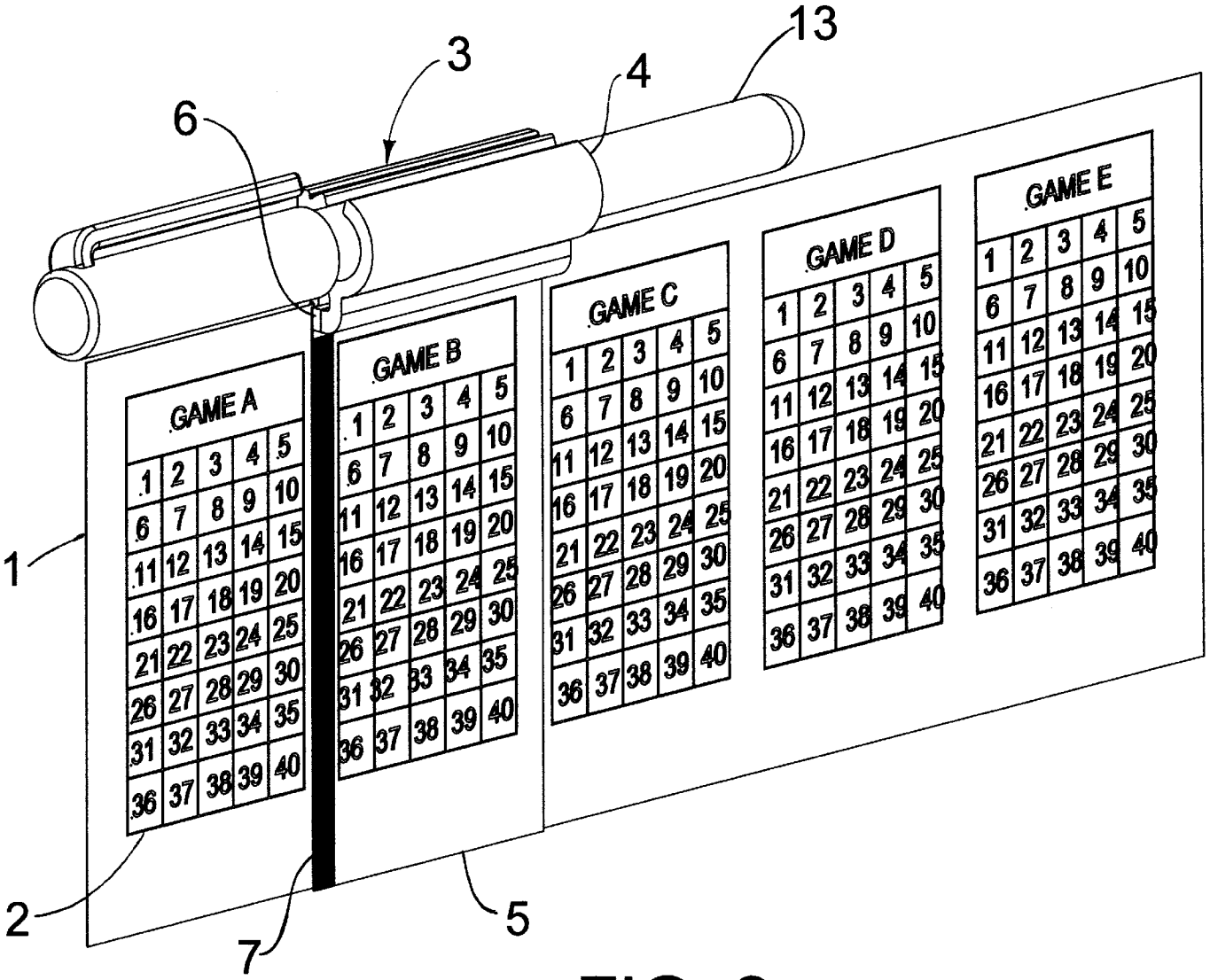
FIG. 2 is an isometric view of the lottery card reader of FIG. 1 clipped to a lottery card.

Referring to FIG. 2, lottery card 1 is printed with five arrays 2 of 40 numbers each, arranged in 8 rows and 5 columns, each array 2 being for a separate lottery game. Over lottery card 1 has been placed lottery card reader 3. Referring to FIGS. 1 and 2, lottery card reader 3 has a clip 4 and a transparent flap 5 attached to clip 4 by adhesive 6. Flap 5 can also be attached to clip 4 by other means, such as rivets or using heat and pressure to bond it to clip 4. Transparent flap 5 is rectangular and large enough to cover any one of the arrays 2 on lottery card 1. Flap 5 is preferable about 3 to about 4 inches long and about 1¾ to about 2 inches wide and can be eraseably written on in ink. Vertical reference line 7 printed on flap 5 enables the user to align flap 5 with any array 2 on lottery card 1.

Clip 4 has a flexible, resilient bridge 8, from which extend rigid four arms 9, 10, 11, and 12. Arms 9 and 10 make contact when lottery card 1 is not between them and grip lottery card 1 when it is between them. Arms 11 and 12 do not make contact and are shaped to hold a writing instrument 13, such as a pen or marker, that can mark transparent flap 5. Bridge 8 functions as a fulcrum so that squeezing arms 11 and 12 together separates arms 9 and 10, releasing lottery card 1. Clip 4 is preferably made of molded or extruded plastic, though it could also be made of metal or other materials. Clip 4 can also be releaseably attached to lottery card 1 by other means, such as a screw or easily releaseable adhesive.

To use lottery card reader 3, writing instrument 13 is removed and arms 11 and 12 are squeezed together, which separates arms 9 and 10. Lottery card reader 3 is then placed over the top of a lottery card 1 so that reference line 7 is aligned with the numbers of at least one game, which can be seen through transparent flap 5. The numbers chosen for two or more lottery games played have already been marked on lottery card 1. For example, if six numbers out of 40 are picked for each game and 2 games have been purchased, one array of numbers might have numbers 5, 9, 19, 27, 29, and 34 marked and another array of numbers might have numbers 3, 7,18, 21, 38, and 39 marked. If the winning numbers are 9, 18, 28, 34, 36, and 39, those numbers are circled or otherwise marked on transparent flap 5. Arms 11 and 12 are squeezed together, separating arms 9 and 10, and lottery card reader 3 is moved across lottery card 1 until the numbers marked on transparent flap 5 coincide with the same symbols on lottery card 1. Arms 11 and 12 are then released, causing bridge 8 to move arms 9 and 10 together, attaching lottery card reader 3 to lottery card 1. If a number is marked on both lottery card 1 and on transparent flap 5 it indicates that a winning number was chosen in that game. For example, numbers 9 and 34 would be marked on both lottery card 1 and flap 5 for the first game and numbers 18 and 39 would be marked on both lottery card 1 and flap 5 for the second game.

Figure 3:
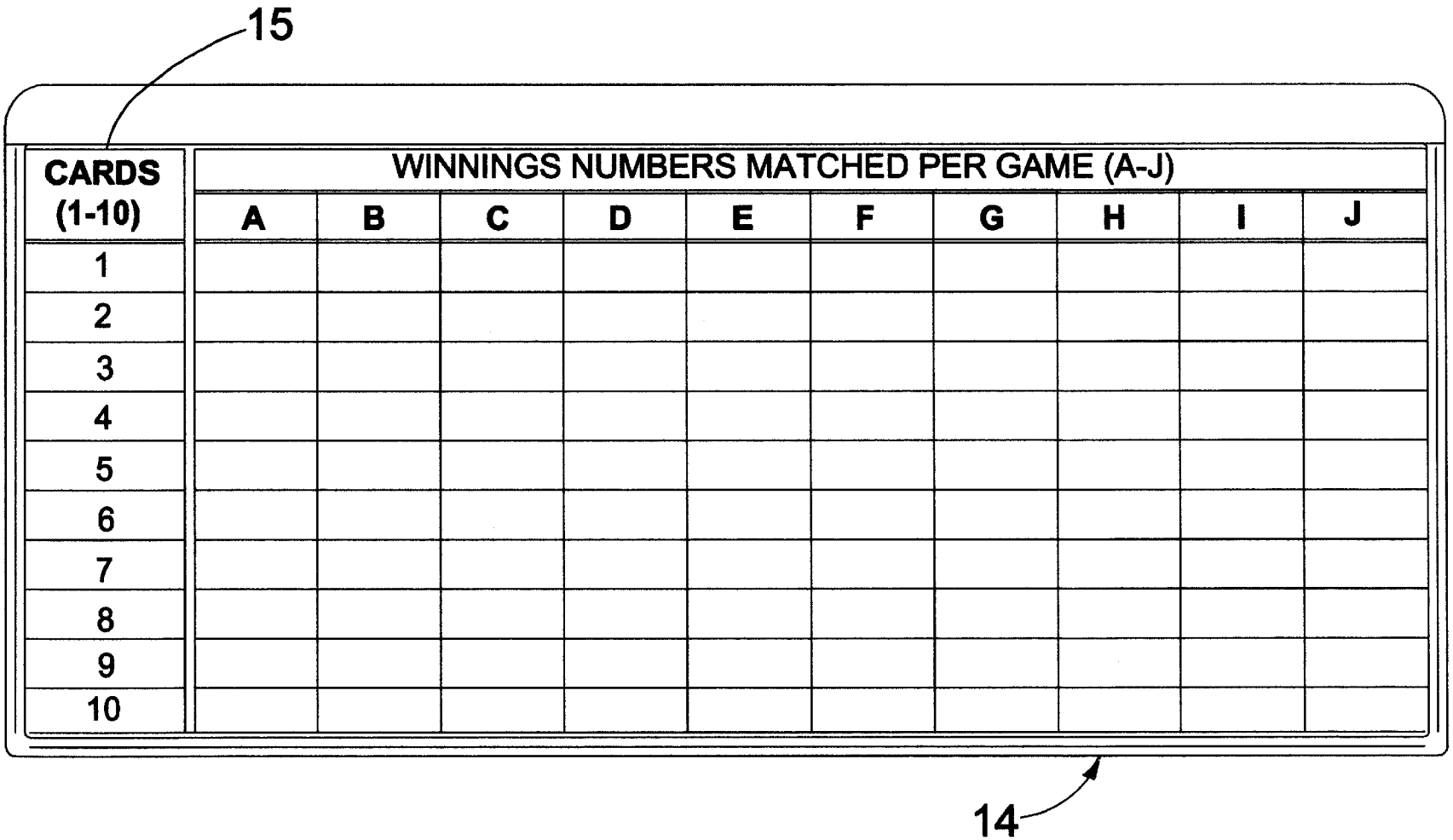
FIG. 3 is a front view of a certain presently preferred embodiment of an envelope for holding lottery cards.

In FIG. 3, an envelope 14 is of a size suitable for holding at least one lottery card. On the face of envelope 14 is printed a table 15. The first column in table 15 has a row numbered for 10 lottery cards and the remaining columns indicated the games playable on each lottery card, in this case labeled A to J. The player can then enter the winning numbers that he selected in the proper row and column and thereby keep track of his winnings. Each of the player's lottery cards can be placed in envelope 14 and lottery card reader 3 can be clipped to envelope 14.

The lottery card reader of this invention can be used to read virtually any lottery card, where the lottery card consists of a rectangular sheet on which are marked numbers, letters, or other symbols. Typically, the card is made of stiff or heavy paper, but plastic or other materials could also be used. A typical lottery card is about 8½ to about 9 inches wide and about 3 to about 3½ inches long. Each card typically holds 4 to 10 identical arrays of numbers, with each array being a separate game that must be purchased to play.

I claim:

1. A lottery card reading assembly comprising (A) a lottery card reader that comprises (1) a clip that can be releaseably attached to any position along an edge of a lottery card, said clip having a resiliently gripping first pair of arms connected to a second pair of separated arms, where moving said second pair of arms together causes said first pair of arms to move apart; and (2) a single transparent flap fixed to said clip, whereby when said first pair of arms grips a lottery card, said flap covers at least one game on said lottery card; and (B) an envelope in which said lottery card can be placed, where a table is printed on said envelope, said table having spaces therein for inserting information about each of a multiplicity of lottery cards.

2. A lottery card reading assembly according to claim 1 wherein said transparent flap can be eraseably written on in ink.

3. A lottery card reading assembly according to claim 1 wherein said clip is molded plastic.

4. A lottery card reading assembly according to claim 1 wherein said transparent flap is about 3 to about 4 inches long and about 1¾ to about 2 inches wide.

5. A lottery card reading assembly according to claim 1 wherein a vertical reference line is printed on said transparent flap.

6. A lottery card reading assembly according to claim 1 wherein said clip can hold a writing instrument.

7. A lottery card reading assembly according to claim 1 further comprising a writing instrument.

8. A lottery card reading assembly according to claim 1 further comprising a lottery card.

9. A lottery card reading assembly according to claim 1, wherein said table has a first column with rows numbered for lottery games and additional columns for indicating the games playable on said lottery card.

10. A lottery card reading assembly according to claim 1 wherein said transparent flap can be written on by an eraseable marker.

11. A lottery card reading assembly according to claim 1 wherein said transparent flap is attached to said arm by adhesive.

12. A lottery card reading assembly according to claim 1 further comprising a marker.

13. A lottery card reading assembly comprising (A) a lottery card reader which comprises (1) a molded plastic clip that comprises a flexible resilient bridge from which extend two opposing pairs of rigid arms, the arms in one pair biased towards each other and the arms in the other pair separated from each other;

(2) a rectangular transparent plastic flap, about 3 to about 4 inches long by about 1¾ to about 2 inches wide, attached to said clip and extending from between said on pair of arms, said flap having a vertical reference line printed thereon;

(B) a writing instrument; and (C) an envelope to which said lottery card reader can be attached, into which at least one lottery card readable by said lottery card reader can be inserted, and upon which is printed a table having spaces therein for inserting information about each of a multiplicity of said lottery cards.

14. A lottery card reading assembly according to claim 13 wherein said writing instrument is a red marker.

* * * * *